United States Patent [19]

Gordon et al.

[11] 3,952,672

[45] Apr. 27, 1976

[54] CORRUGATED DISPOSABLE PALLET

[75] Inventors: Robert Lewis Gordon; Keith Alan Cooper, both of Monroe, N.Y.

[73] Assignee: International Paper Company, New York, N.Y.

[22] Filed: Dec. 19, 1974

[21] Appl. No.: 534,467

[52] U.S. Cl. ..... 108/56; 5/DIG. 1; 108/51; 229/23 AB; 248/174

[51] Int. Cl.[2] ..... B65D 19/34

[58] Field of Search ..... 108/51–58; 206/386; 229/23 A, 23 AB, 23 C; 217/43 A; 297/440, 442; 248/152, 174; 312/259; 5/DIG. 1

[56] References Cited

UNITED STATES PATENTS

| | | | |
|---|---|---|---|
| 2,444,183 | 6/1948 | Cahners | 108/56 |
| 2,576,715 | 11/1951 | Farrell | 108/55 X |
| 2,955,647 | 10/1960 | Smith | 297/442 X |
| 2,996,276 | 8/1961 | Sorensen et al. | 108/57 |
| 3,000,603 | 9/1961 | Hemann | 108/56 |
| 3,131,656 | 5/1964 | Houle | 108/56 |
| 3,302,593 | 2/1967 | Roberts | 108/56 |
| 3,464,371 | 9/1969 | Gifford | 108/51 X |
| 3,871,726 | 3/1975 | Stegner | 312/259 X |

*Primary Examiner*—Roy D. Frazier
*Assistant Examiner*—William E. Lyddane
*Attorney, Agent, or Firm*—Richard M. Barnes

[57] ABSTRACT

A pallet of foldable material comprising a unitary outer structure folded about and joined to a unitary inner structure said pallet being easily assembled and disassembled.

18 Claims, 4 Drawing Figures

CORRUGATED DISPOSABLE PALLET

BACKGROUND OF THE INVENTION

1. Field of the Invention

Heavy loads have long been moved by stacking the load on a pallet and then lifting the loaded pallet with a fork truck. The pallets originally used in the art were made of wood but these pallets had numerous disadvantages. First, the labor and material costs involved in producing wooden pallets were relatively high. As a consequence of these high costs, the recipient of goods shipped upon wooden pallets was often required to return the pallets to the shipper or supplier for reuse. This, of course, resulted in higher shipping costs. Additionally, wooden pallets generally could not be easily disassembled to lie flat thereby necessitating excess storage space when not in use. Finally, wooden pallets are relatively heavy thereby adding to shipping costs as well as making it difficult to manually move the pallets from one position to another. Plastic and metals have also been suggested as materials for the production of pallets but the resulting pallets have suffered from essentially the same disadvantages as wooden pallets.

As a result of the disadvantages of wooden, plastic, and metal pallets, prior art workers have long endeavored to construct pallets of other material. Foldable material, such as corrugated paper board, has been frequently suggested as an alternative material for the construction of pallets. This invention relates to an improved pallet constructed of foldable material such as corrugated paper board.

2. Description of the Prior Art

As indicated above, prior art workers have frequently suggested that pallets be constructed of foldable material such as corrugated paper board. One prior art structure, U.S. Pat. No. 3,216,376 to Anderson et al, requires four component parts and further requires complex hinged joints to permit the pallet to be flattened when not in use. Another prior art structure, U.S. Pat. No. 3,659,534 to Childs, requires a complicated folding operation including stitching or stapling the component parts together to provide the final structure. Yet another structure, U.S. Pat. No. 2,444,183 to Cahners, requires both multiple component parts and the use of staples, adhesives or other fastening means. Other prior art structures represented by U.S. Pat. Nos. 3,464,371 to Gifford, 3,302,593 to Roberts, 3,131,656 to Houle, 3,115,105 to Allen, and 2,446,914 to Fallert et al require complex multiple components or external fastening means or both.

The closest prior art pallet of which we are aware, U.S. Pat. No. 2,576,715 to Farrell, suffers from the same disadvantages as the prior art pallets noted above. First, the Farrell pallet requires at least three blanks while the pallet of our invention requires only two blanks. Additionally, the Farrell pallet requires stapling to secure the center support cell and overlying flaps while our structure is especially designed so that no external securing means are required. As a consequence of the differences, it is readily apparent that our pallet is more readily assembled and disassembled to lie flat than the Farrell pallet. Disassembly is particularly burdensome in the preferred embodiment of the Farrell pallet due to the complicated cell structure required. Additionally, the Farrell structure is weakened by the numerous staplings and unstaplings required during repeated assemblies and disassemblies.

It will be further noted that the Farrell pallet is provided with only two sets of truck fork lift holes. The pallet of our invention is superior in yet another way, since it provides for up to four sets of fork lift holes thereby permitting entry from any side of the pallet.

SUMMARY OF THE INVENTION

The present invention comprises a pallet including an outer structure folded about an inner structure. The unitary inner structure comprises a flat deck with two support cells extending along two opposite sides thereof. The inner structure support cells contain at least one set of aligned slots along their upper horizontal and inside vertical walls.

The outer structure comprises a flat deck substantially abutting the inner structure deck with folded flaps extending from opposite sides of the outer structure deck and folded about the ends of the inner structure support cells. The outer structure is attached to the inner structure by tuck flaps inserted into the inner cell slots.

The pallet of the present invention is characterized by its double wall strength, its few component parts, the absence of external fastening means, its low cost, its low weight, and its easy assembly as well as its easy disassembly to lie flat when not in use.

DESCRIPTION OF THE PREFERRED EMBODIMENTS

Figure 1:
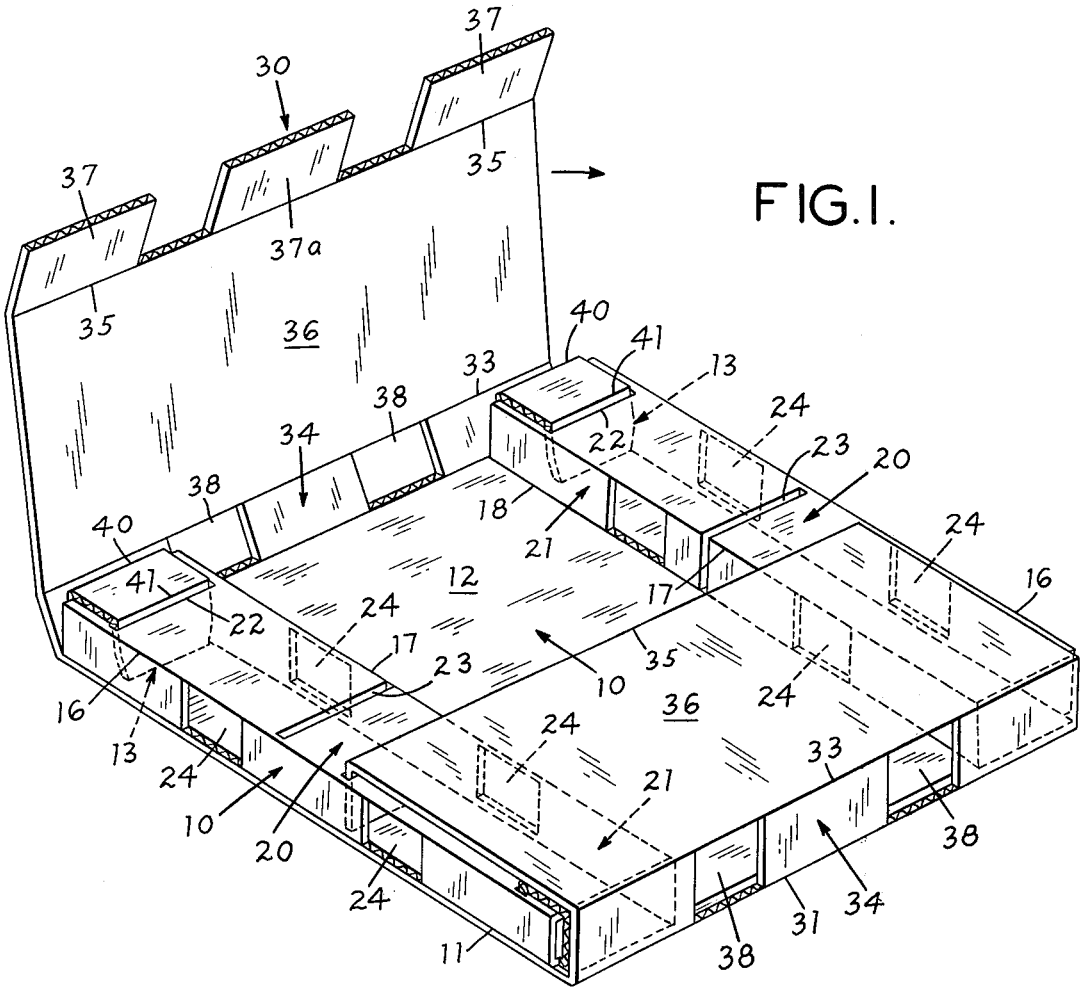
FIG. 1 is a perspective view of the preferred embodiment of the invention in partially erected position.
Figure 2:
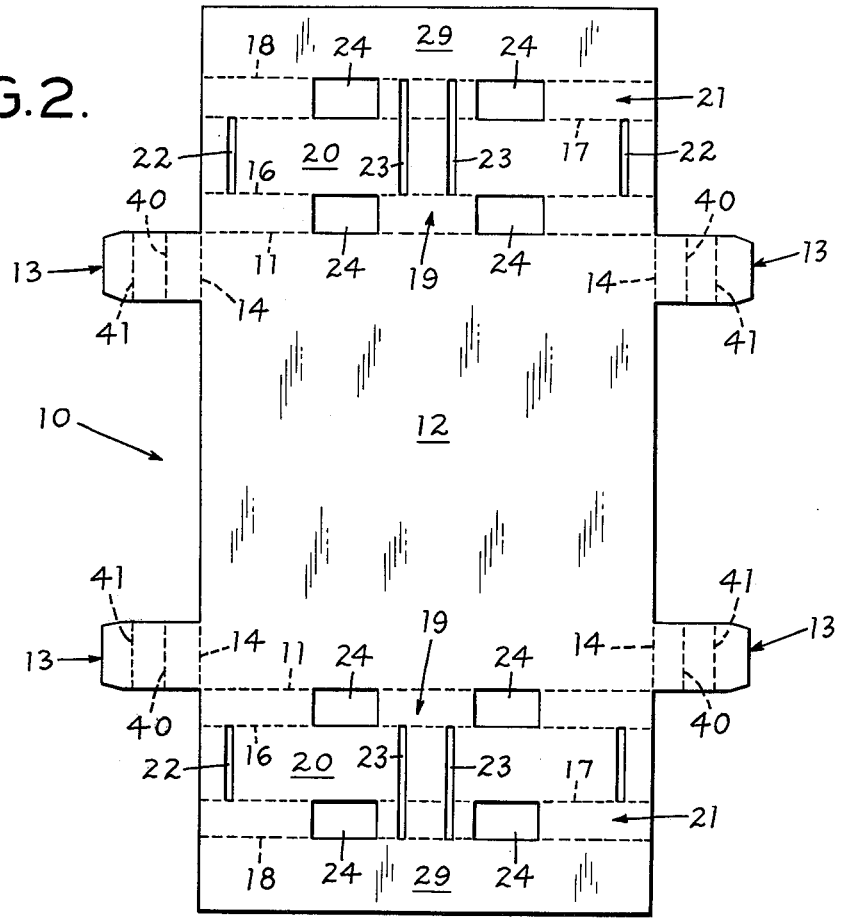
FIG. 2 is a view of the inner structure blank in the preferred embodiment of the invention.

Referring to FIG. 2, there is shown the inner structure blank 10 of foldable sheet material which may, for example, be corrugated paper board. The blank 10 is scored along lines 11 to define a generally rectangular flat deck 12 from which preferably extend four tabs 13 defined from the deck portion by score lines 14. It will be noted that the tabs are preferably scored along lines 40 and 41 in order to aid their insertion into later mentioned cuts in the horizontal walls of support cells. The blank is further scored along lines 16, 17, and 18 so as to provide upon folding, two support cells containing outer vertical walls 19, upper horizontal walls 20, inner vertical walls 21, and, preferably, double cell bottom walls 29. Support cell stability is provided for by four cuts 22 which receive the tabs 13 upon folding the inner structure 10 as best seen from FIG. 1. The inner structure blank is further provided with two sets of slots 23 extending across the support cell inner vertical walls 21 and upper horizontal walls 20. The slots must be suitably aligned to receive common later mentioned tuck flaps. Finally, the inner structure blank is preferably provided with eight lift entry holes 24 as shown in FIG. 2.

Figure 3:
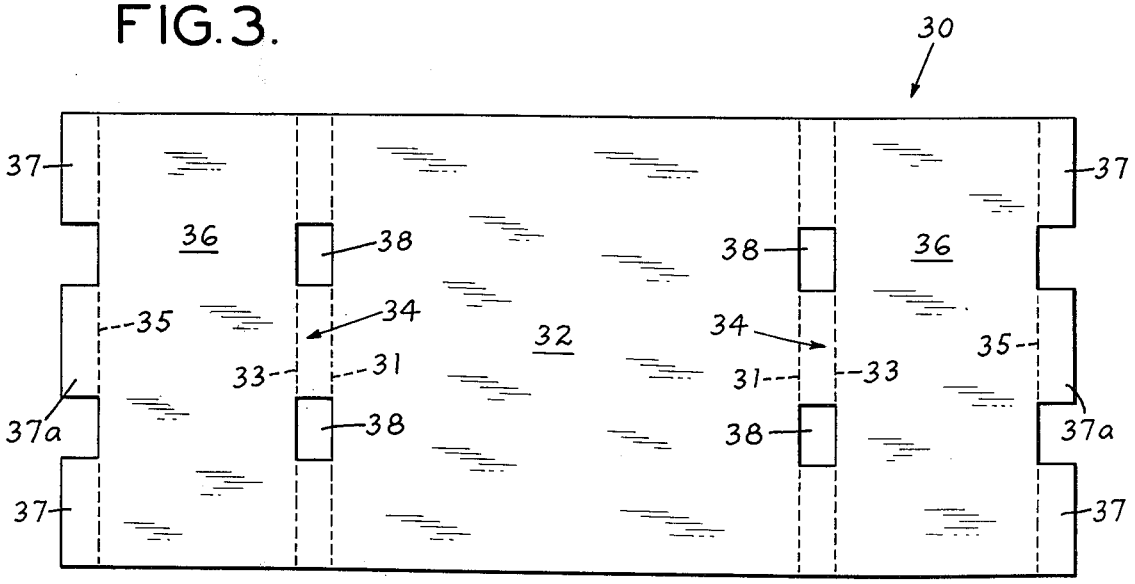
FIG. 3 is a view of the outer structure blank in the preferred embodiment of the invention.

Referring now to FIG. 3, there is shown the outer structure blank 30 of foldable sheet material which, for example, may be corrugated paper board. The blank 30 is scored along lines 31 to provide a flat deck 32 of substantially the same size and shape as flat deck 12 of inner structure 10. The blank is further scored along lines 33 so as to provide upon folding two vertical walls 34 of essentially the same height as vertical walls 19 and 21 of the inner structure 10. The inner structure is further scored along lines 35 to provide flaps 36, tuck flaps 37 and support flaps 37*a* of suitable dimension so that upon folding as shown in FIG. 1, the inner structure is joined to the outer structure by insertion of the tuck flaps 37 into the slots 23 of the inner structure. Preferably, the tuck flaps 37 and support flaps 37*a* are about the same dimension as the vertical walls of the inner and outer structures so as to provide additional support to the pallet. Finally, the outer structure blank is preferably provided with eight fork lift entry holes 38 as shown in FIG. 3. It will be understood, however, that when fewer than eight fork lift entry holes are provided, the tuck flaps may consist of a continuous piece of foldable sheet material defined by score line 35.

Figure 4:
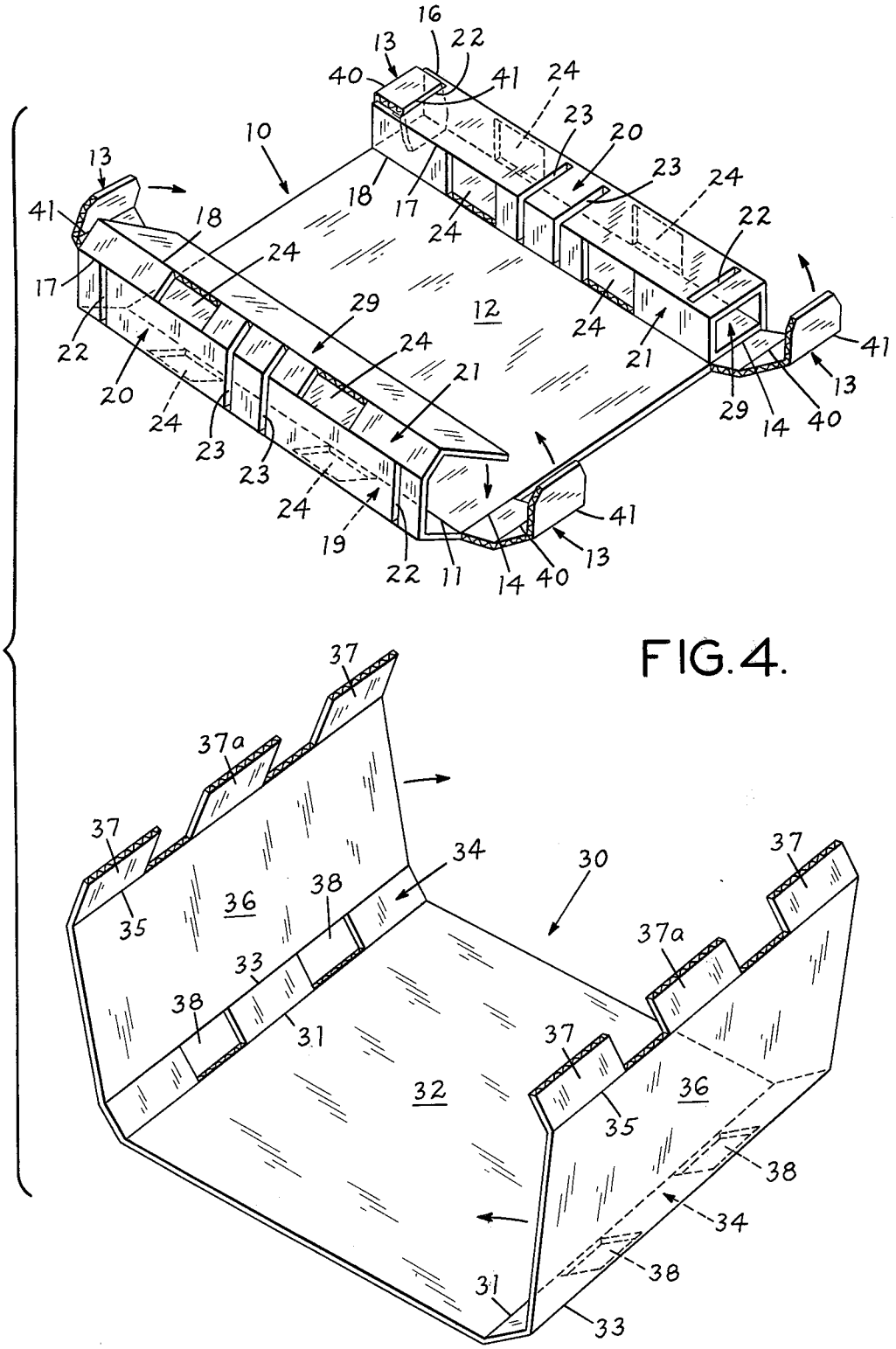
FIG. 4 is a perspective view of partially erected blanks in position just prior to construction of the pallet.

As is best seen from FIGS. 1 and 4, the pallet of the present invention is constructed by first folding the inner structure blank so as to provide a flat rectangular deck with support cells extending along two opposite sides thereof. The outer structure deck is then placed and desirably adhesively bonded against the inner structure deck as is seen from FIGS. 1 and 4. Next, the outer structure flaps are folded about the ends of the inner structure support cells and the tuck flaps are inserted into the inner cell slots as is seen from FIGS. 1 and 4.

The pallet provided by the present invention requires only two component parts which may be easily assembled and disassembled. It is contemplated that the pallet may be made in a variety of sizes from any number of low cost materials which may be folded into the described pallet. For example, the pallets of the present invention may be made from cardboard, fiberboard and the like. In view of its low cost, the pallet may be disposed of by those who have no future use for it, but yet, it is sturdy enough to be used many times. Additionally, the pallet may be easily disassembled to lie flat while not in use.

It will be noted that the pallet provided for above has double wall strength throughout much of its structure. Yet, additional support may be provided for by modifying the inner and outer structure blanks. For instance, inner structure blank 10 may be extended and scored beyond double bottom walls 29 to provide additional walls along the inside of the support structure cells. Alternatively, part of the extension may be employed to provide a diagonal support wall extending, for example, between the bottom of the outside vertical wall of the support cell and the top of the inside vertical wall of the support cell. Additional support may also be provided by extending and scoring the outer structure beyond tuck flaps 37 to provide a double tuck flap to be inserted into the same slot as the tuck flap.

It should be understood that all the features described in the preferred embodiment above need not be present to obtain a desirable pallet. For example, tabs 13, cuts 22, and double wall 29 are not required in the pallet of the present invention. Neither is it required that the inner and outer decks be adhesively bonded. Further, it will be appreciated that the pallet may be provided with fewer sets of fork left entry holes. Even further, it will be understood that only a single set of aligned slots into which both sets of tuck flaps are inserted is required. Thus, it will be appreciated that the scope of the present invention is defined by the claims appended hereto.

We claim:

1. A pallet which comprises:

a. a unitary inner structure of foldable material comprising
   i. a flat deck,
   ii. two folded support cells extending along opposite sides of the flat deck containing at least an outside vertical wall, an upper horizontal wall, and an inside vertical wall;
   iii. at least one set of aligned slots along the upper horizontal and inside vertical walls of the support cells; and b. a unitary outer structure of foldable material comprising,
   i. a flat deck abutting the flat deck of the inner structure,
   ii. two vertical walls extending from opposite edges of said flat deck and folded about the ends of said inner structure support cells,
   iii. two flaps extending respectively from said vertical walls and folded along the upper horizontal support cell walls,
   iv. two tuck flaps extending respectively from said flaps and inserted into said slots in said support cells.

2. The pallet of claim 1 wherein the inner and outer structure flat decks are adhesively bonded.

3. The pallet of claim 1 wherein the inner and outer structures are formed from paper board.

4. The pallet of claim 3 wherein the paper board is corrugated paper board.

5. The pallet of claim 1 wherein there are two sets of slots juxtaposed in parallel alignment in the inner structure support cells.

6. The pallet of claim 1 wherein the inner structure support cells contain a double bottom horizontal wall.

7. The pallet of claim 1 containing at least one set of fork lift holes.

8. The pallet of claim 1 wherein four tabs extending from the four corners of the inner structure deck are inserted into four cuts provided in the horizontal walls of the inner structure support cells.

9. The pallet of claim 1 wherein the tuck flaps are about the same dimension as the inner and outer structure vertical walls so as to provide additional support to the pallet structures.

10. A pallet which comprises:

a. a unitary inner structure of foldable material comprising,
   i. a flat deck,
   ii. two folded support cells extending along opposite sides of the flat deck containing at least one outside vertical wall, an upper horizontal wall containing two cuts disposed in a direction normal to said vertical wall, an inside vertical wall, and a double bottom horizontal wall,
   iii. two sets of slots juxtaposed in parallel alignment along the upper horizontal and inside vertical walls of the support cells,
   iv. four tabs extending from the four corners of the flat deck inserted into said cuts provided in the horizontal walls of the support cells; and b. a unitary outer structure of foldable material comprising,
   i. a flat deck abutting the flat deck of the inner structure, ii. two vertical walls extending from opposite edges of said flat deck and folded about the ends of the inner structure support cells, iii. two flaps extending respectively from said vertical walls and folded along the upper horizontal support cell walls, iv. two tuck flaps extending respectively from said flaps and inserted into said slots of the inner structure in said support cells, said tuck flaps being substantially of the same dimension as the inner and outer structure vertical walls so as to provide additional support to the pallet structure.

11. The pallet of claim 10 wherein the inner and outer structure flat decks are adhesively bonded.

12. The pallet of claim 10 wherein the inner and outer structures are constructed of paper board.

13. The pallet of claim 12 wherein the paper board is corrugated paper board.

14. The pallet of claim 10 containing at least one set of fork lift holes.

15. The pallet of claim 7 wherein the one set of fork lift holes extends through a vertical wall of said unitary outer structure and contains a second set of fork lift holes extending through the vertical walls of a support cell in said unitary inner structure.

16. The pallet of claim 14 wherein the one set of fork lift holes extends through a vertical wall of said unitary outer structure and contains a second set of fork lift holes extending through the vertical walls of a support cell in said unitary inner structure.

17. The pallet of claim 9 wherein the at least one set of aligned slots are centrally disposed along the length of said support cells.

18. The pallet of claim 10 wherein the two sets of slots are centrally disposed along the length of said support cells.

* * * * *